US006299302B1

(12) United States Patent
DeBoer et al.

(10) Patent No.: US 6,299,302 B1
(45) Date of Patent: Oct. 9, 2001

(54) INK JET RECEIVER SHEET WITH REMOVABLE INK DELIVERY LAYER

(75) Inventors: Charles D. DeBoer, Palmyra; Werner Fassler; Judith L. Fleissig, both of Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/215,396

(22) Filed: Dec. 18, 1998

(51) Int. Cl.[7] ..... B41J 2/01
(52) U.S. Cl. ..... 347/105; 428/195
(58) Field of Search ..... 347/105; 428/195

(56) References Cited

U.S. PATENT DOCUMENTS 4,306,245 12/1981 Kasugayama et al. .
4,679,059 7/1987 Dagna .
4,746,938 5/1988 Yamomori et al. .
4,853,717 8/1989 Harmon et al. .
4,855,764 8/1989 Humbs et al. .
5,120,601 * 6/1992 Kotaki et al. ..... 347/105
5,984,467 * 11/1999 Bodager et al. ..... 347/105
6,137,516 * 10/2000 Malhotra et al. ..... 347/105

* cited by examiner

*Primary Examiner*—Thinh Nguyen
*Assistant Examiner*—Manish S. Shah
(74) *Attorney, Agent, or Firm*—Raymond L. Owens

(57) ABSTRACT

An ink jet receiver which provides variable dot sizes, comprising a substrate, an ink-receiving layer disposed over the substrate, and a removable ink delivery layer which, in response to a droplet of ink, absorbs a portion of the ink and delivers another portion of the ink to the ink receiving layer so that a dot is formed in the ink-receiving layer.

7 Claims, 1 Drawing Sheet

INK JET RECEIVER SHEET WITH REMOVABLE INK DELIVERY LAYER

FIELD OF THE INVENTION

This invention relates to ink jet printing and, more particularly, to ink jet receiver sheets for high quality printing.

BACKGROUND OF THE INVENTION

Ink jet printing is a non-impact method for producing images by the deposition of ink droplets on a substrate (paper, transparent film, fabric, etc.) in response to digital signals. Ink jet printers have found broad applications across markets ranging from industrial labeling to short run printing to desktop document and pictorial imaging. In recent years the drop size of ink jet printers has tended to become smaller and smaller, resulting in higher resolution and higher quality prints. The smaller drop size is accompanied by smaller nozzle openings in the inkjet printhead. These smaller nozzle openings are easier to plug and more sensitive to extraneous deposits which can affect both the size and placement accuracy of the ink jet drop.

The use of ink jets with smaller drop sizes has resulted in a need to maintain the ink ejecting nozzles of an ink jet printhead, for example, by periodically cleaning the orifices when the printhead is in use, and/or by capping the printhead when the printer is out of use or is idle for extended periods of time. The capping of the printhead is intended to prevent the ink in the printhead from drying out. There is also a need to prime a printhead before use, to insure that the printhead channels are completely filled with ink and contain no contaminants or air bubbles and also periodically to maintain proper functioning of the orifices. Maintenance and/or priming stations for the printheads of various types of ink jet printers are described in, for example, U.S. Pat. Nos. 4,855,764; 4,853,717; and 4,746,938. Removal of gas from the ink reservoir of a printhead during printing is described in U.S. Pat. No. 4,679,059. In U.S. Pat. No. 4,306,245 to Kasugayama et al., a liquid jet recording device provided with a cleaning protective means for cleaning and protecting an orifice is described. The cleaning protective means is provided at a reset position lying at one end of the scanning shaft of the device.

With smaller drop sizes, the required cleaning of the ink jet print heads becomes more frequent and takes longer. This results in long printing times, and the cost of the equipment is more expensive. These costs are, in part, a result of the fact that the available ink jet receivers produce a relatively large dot of color for a given ink drop size.

One approach to overcome these difficulties is to use extra inks for light colored areas, in order to hide or make less visible the pattern created by the dots of ink in light colored areas. However, extra inks require more expensive equipment, because additional ink cartridges are needed for the light colored inks. In addition, it is well known to those skilled in the art that strong hue shifts toward muddy colors, particularly in light colors, are caused by having white areas of receiver showing between small dots of colored ink.

SUMMARY OF THE INVENTION

It is an object of the present invention to provide a new receiver structure that can employ large droplet ink jet printers to produce low density areas of pictorial images with reduced pattern and dot visibility and thereby minimize the problems discussed above.

These objects are achieved by an ink jet receiver which provides variable dot sizes, comprising:

a) a substrate;

b) an ink-receiving layer disposed over the substrate; and c) a removable ink delivery layer which, in response to a droplet of ink, absorbs a portion of the ink and delivers another portion of the ink to the ink receiving layer so that a dot is formed in the ink-receiving layer.

ADVANTAGES

An advantage of this invention is that, in accordance with the present invention, include a removable ink deliver layer which receives the ink droplets and delivers them to an ink receiving layer. This new receiver structure minimizes many of the prior art problems and is compatible with existing ink jet printers.

Another advantage of this invention is that more saturated low density colors can be printed because the color can more completely cover the ink receiving layer, reducing white space between the colored pixels and thereby improving the hue of the colors.

DETAILED DESCRIPTION OF THE INVENTION

The term "ink" as used herein, will be understood to mean liquids which carry a color or stain of any kind, whether produced by suspended particles of pigment or soluble dyes, or by any other means.

Figure 1:
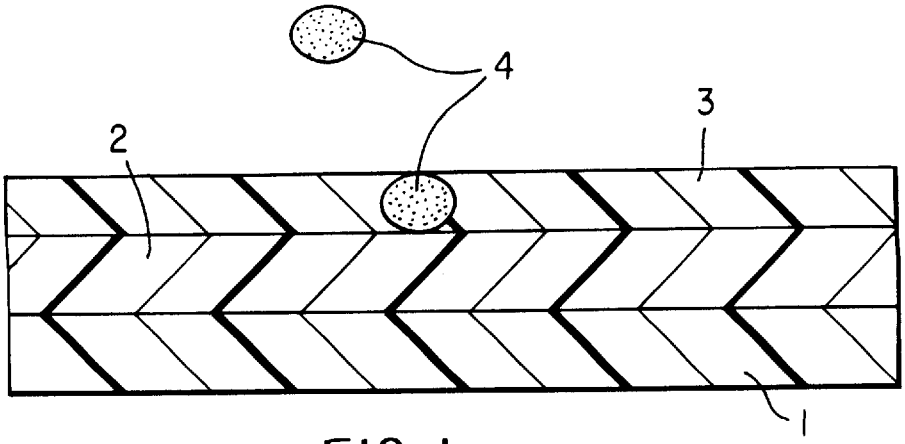
FIG. 1 is a cross sectional view of a receiver in accordance with the present invention during the printing process.
Figure 2:
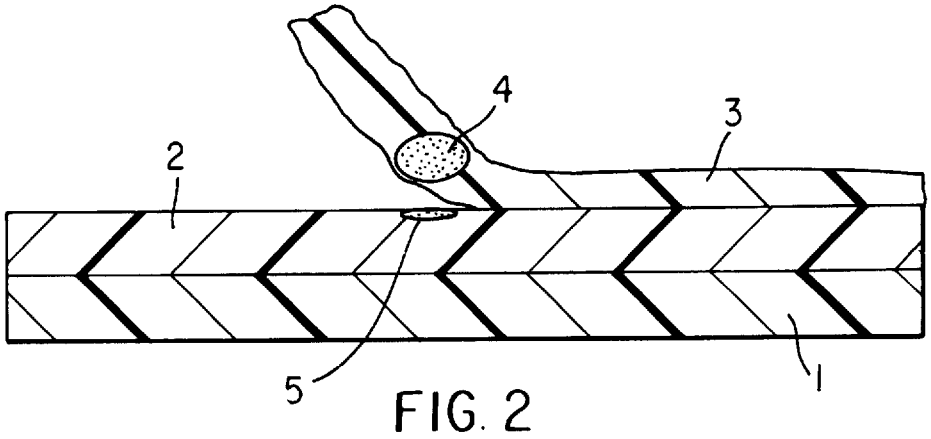
FIG. 2 is a cross sectional view of the receiver of FIG. 1 showing the removal of the removable ink delivery layer.

Turning to FIG. 1, a substrate 1 is shown with an ink receiving layer 2 over the substrate. Over the ink receiving layer 2 is a removable ink delivery layer 3. Ink droplets 4 from an ink jet printer are shown in and approaching the removable ink delivery layer 3. Most of the ink droplet 4 is contained within the ink delivery layer 3, with only a small portion of the ink droplet moving into the ink receiving layer 2. Thus, a large droplet of ink results in a small drop of ink in the final image when the removable ink delivery layer 3 has been removed. FIG. 2 illustrates the process, showing the remaining small ink droplet 5 when the removable ink delivery layer 3 has been removed.

Figure 3:
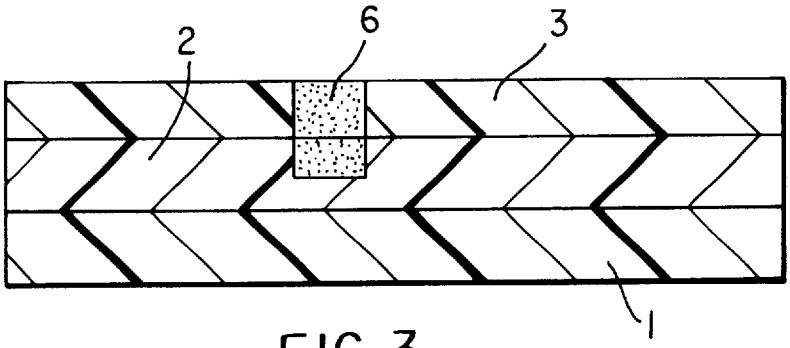
FIG. 3 is a cross sectional view of another embodiment of the receiver in accordance with the present invention which operates in an equilibrium spreading mode.

FIG. 3 shows a second mode of operation of the invention, in which the ink droplet is allowed to reach equilibrium distribution of ink 6 throughout the layers. The equilibrium distribution of ink tends to fill more of the white space of the receiver between the dots of color, producing no spacing between such dots of color. This is important to improve the hue of the lighter colors (low image area densities). This hue shift is known to those skilled in the art to be due to the Yule-Nielsen effect of the inefficient light reflection of light scattering substrates such as paper. Light which impinges on the white areas of the substrate is diffused through the paper fibers and partially absorbed, resulting in a final reflection of a color of diminished, or muddy, hue. Such effects can be seen in the Pantone Process Color Simulator 747XR, from Pantone, Inc., 55 Knickerbocker Road, Moonachie, N.J. A particularly dramatic example is found on page 37.5 C, comparing the Pantone FOIO-C four color process patch with the Pantone 3375 C solid color patch.

The substrate for the inkjet receiver of this invention can be can be composed of paper, metal, or polymer (such as polyesters or polyimides) sheets, foils or laminates thereof, as long as they have the requisite properties. Paper substrates are preferred for low cost, but polymer substrates may be used when a particular property such as dimensional stability or smoothness is required. The substrate may be coated with a sizing agent such as starch or clay, or may be coated with any of the conventional "subbing" materials (such as vinylidene chloride polymers) used to prepare photographic films in the photographic art to insure good adhesion of the layers coated over the substrate.

Substrates can have any desired thickness that would be useful for a given application. For a plain paper "feel" a thickness of about 100 microns is suitable.

The ink receiving layer can be composed of a number of essential components that include clay, one or more water-soluble binders, and one or more hardening agents. In preferred embodiments, this layer also includes one or more colloidal silicas. Useful clays may be either synthetic or naturally occurring materials. They include, but are not limited to, kaolin (aluminum silicate hydroxide) which is to be understood to include the minerals kalinite, dickite, nacrite and halloysite-endellite. Other useful clays include, but are not limited to, the serpentine clays (including the minerals chrysotile, amersite, cronstedite, chamosite and garnierite), the montmorillonites (including the minerals beidellite, nontronite, hextorite, saponite and sauconite), the illite clays, glauconite, chlorites, vermiculites, bauxites, attapulgites, sepiolites, palygorskites, corrensites, allophanes, imogolites, diaspores, boehmites, gibbsites, cliachites and mixtures thereof. In addition, synthetic clays such as laponite and hydrotalcite (a chemical composition comprising magnesium aluminum hydroxy carbonate hydrate) may be used. Kaolin is preferred. Mixtures of these clays can also be used if desired. They can be obtained from a number of commercial sources including for example, ECC International and Southern Clay Products.

When colloidal silica is present, it can be obtained from a number of commercial sources, for example as LUDOX SM-30 from duPont, and as Nalco 2326 from Nalco Corporation.

One or more useful water-soluble binders include both inorganic and organic binder materials such as, but not limited to, gelatin (and gelatin derivatives known in the photographic art), water-soluble cellulosic materials (for example hydroxypropylcellulose, hydroxyethylcellulose, hydroxypropylmethylcellulose and carboxymethylcellulose), water-soluble synthetic or naturally occurring polymers (for example polyvinyl alcohol, poly(vinylpyrrolidones), polyacrylamides, water-absorbent starches, dextrin, amylogen, and copolymers derived from vinyl alcohol, acrylamides, vinyl pyrrolidones and other water-soluble monomers], gum arabic, agar, algin, carrageenan, fucoidan, laminaran, corn hull gum, gum ghatti, karaya gum, locust bean gum, pectin, guar gum and other water-soluble film-forming materials that would be readily apparent to one skilled in the art. The cellulosic materials are preferred. Mixtures of any of these materials can be used also for this purpose. By "water-soluble" is meant that the material can form a greater than 1% solution in water. Such water-soluble binder materials can be readily prepared from known starting materials using conventional starting materials, or obtained from a number of commercial sources, including Eastman Chemical Company (for cellulosic materials), Dow Chemical Company and Aldrich Chemical Company.

Another essential component of the ink receiving layer is one or more hardening agents. The complete function of these materials is uncertain, but when they are omitted, the clay-containing layer is less cohesive and adhesive, and has less wearability. Useful hardening agents include, but are not limited to, tetraalkoxysilanes (such as tetraethoxysiliane and tetramethoxysilane) and silanes having at least two hydroxy groups [such as 3-aminopropyltrihydroxysilane, glycidoxypropyltriethoxysilane, 3-aminopropylmethyldihydroxysilane, 3-(2-aminoethyl) aminopropyltrihydroxy silane, N-trihydroxysi lylpropyl -N,N,N-trimethylammoniumchloride, trihydroxysilylpropanesulfonic acid and salts thereof]. The first two compounds in this list are preferred. These materials can be readily obtained from several commercial sources including Aldrich Chemical Company.

Another optional but preferred material is a coating surfactant, such as CT-121 (Air Products Corporation), ZONYL™ FSN nonionic surfactant (duPont), Olin 10G (Olin Corporation) and FLUORAD™ FC 431 nonionic surfactant (3M Company). The fluorosurfactants are preferred, and ZONYL™ FSN nonionic surfactant is most preferred.

Still other optional component of the ink receiving layer is one or more metal oxides of silicon, beryllium, magnesium, aluminum, germanium, arsenic, indium, tin, antimony, tellurium, lead, bismuth or transition metals. For purposes of this application, silicon is considered a "metal". Silicon oxide, aluminum oxide, titanium oxide and zirconium oxide compounds are preferred, and silicon oxide and titanium oxide compounds are most preferred, in the practice of this invention. Mixtures of oxides can also be used in any combination and proportions.

Additional materials useful in the ink receiving layer include fillers (such as ground limestone, talc, calcium sulfate, barium sulfate, titanium dioxide, zinc oxide, zinc sulfide, zinc carbonate, titanium white, aluminum silicate, diatomaceous earth, calcium silicate, magnesium silicate, aluminum hydroxide, alumina and lithopone), pigments (such as styrene-based plastic pigments, acrylic-based plastic pigments, microcapsules and urea resin pigments), pigment dispersants, thickeners, blowing agents, penetrants, dyes or colored pigments, optical brighteners, ultraviolet radiation absorbers, antioxidants, preservatives and antifungal agents.

The amounts of the essential components, and some optional but preferred components of the ink receiving layer as shown in TABLE I below. The amounts are for dry coating weight percentages, and all ranges are considered approximate at each range end point (that is "about").

TABLE I

| COMPONENT | GENERAL AMOUNT | PREFERRED AMOUNT |
|---|---|---|
| Clay | 30–80% | 50–70% |
| Colloidal silica | 15–50% | 20–40% |
| Water-soluble polymer binder | 2–15% | 5–12% |

TABLE I-continued

| COMPONENT | GENERAL AMOUNT | PREFERRED AMOUNT |
|---|---|---|
| Hardening agent | 1–10% | 1–5% |
| Surfactant | 0.01–1% | 0.1–0.5% |

In most preferred embodiments, the ink receiving layer is composed of about 62% of clay, about 29% of colloidal silica, about 8% of a cellulosic binder, and about 4% of a hardening agent, all percentages being based on total layer dry weight. The remainder of the layer can be composed of the various addenda described herein.

The materials in the ink receiving layer can be applied to the support in any suitable manner using conventional coating equipment and procedures. Upon drying, the ink receiving layer is generally at least 0.1 $\mu$m in thickness and can be as thick as 30 $\mu$m.

Other compositions of the ink receiving layer such as those which are sold commercially, are also included in the scope of this invention. Such commercial ink receiving layers include those comprising silica layers, boehmite layers, and ink receiving layers composed of swelling polymers.

The removable ink delivery layer can be a layer of a single material, a mixture of materials, or two or more separate layers of materials. Single component single can be prepared from the family of water soluble polymers including gelatin (and gelatin derivatives known in the photographic art), water-soluble cellulosic materials (for example hydroxypropylcellulose, hydroxyethylcellulose, hydroxypropylmethylcellulose and carboxymethylcellulose), water-soluble synthetic or naturally occurring polymers [for example polyvinyl alcohol, poly(vinylpyrrolidones), polyacrylamides, water-absorbent starches, dextrin, amylogen, and copolymers derived from vinyl alcohol, acrylamides, vinyl pyrrolidones and other water-soluble monomers], gum arabic, agar, algin, carrageenan, fucoidan, laminaran, corn hull gum, gum ghatti, karaya gum, locust bean gum, pectin, guar gum and other water-soluble film-forming materials that would be readily apparent to one skilled in the art. The cellulosic materials are preferred. Mixtures of any of these materials can be used also for this purpose. By "water-soluble" is meant that the material can form a greater than 1% solution in water. Such water-soluble binder materials can be readily prepared from known starting materials using conventional starting materials, or obtained from a number of commercial sources, including Eastman Chemical Company (for cellulosic materials), Dow Chemical Company and Aldrich Chemical Company. The layers can be coated by any of the conventional coating means such as extrusion hopper coating, wire wound rod coating, gravure coating, reverse gravure coating, bill-blade coating and similar coating methods which will be apparent to those skilled in the art. The thickness of the removable ink delivery layer will depend on the drop size of the inkjet printer being used. The removable ink delivery layer must be thick enough to absorb and contain a significant portion of the ink droplet, so that only portion of the ink is delivered to the ink receiving layer. In practice, the emovable ink delivery layer should be between 1 and 10 microns in thickness, with a preferred thickness of 2 to 5 microns in thickness.

Optional layers may be coated over the removable ink delivery layer to help to absorb and contain a portion of the ink droplet. Such layers may also add strength to the removable layer, allowing it to peeled from the ink receiving layer without tearing. Such optional layers can be prepared from the family of water soluble polymers named above, or can be prepared of the same materials used to make the ink receiving layer.

The use of the ink jet receiver of this invention in the equilibrium spreading mode is as follows: The coated substrate is loaded into an ink jet printer controlled by a computer. The desired image is printed at high density and allowed to equilibrate. Then the removable ink delivery layer is peeled from the ink receiving layer, revealing the correct density image with more uniform ink coverage in the low density areas.

The use of the ink jet receiver of this invention in the non-equilibrium mode is as follows: The coated substrate is loaded into an ink jet printer controlled by a computer. The desired image is printed at high density and the removable ink delivery layer is peeled from the ink receiving layer at a fixed time after the ink has been printed, revealing the correct density image with small dots in the low density areas. Example:

A mixture of 144 g of dry kaolin (Eccatex 540 from ECC International), 240 g water, 240 g of 30% colloidal silica in water (LUDOX SM-30 from duPont), 408 g of 5% hydroxypropylmethylcellulose in water (METHOCEL K100LV from Dow Chemical), and 12 g of surfactant (CT-121 from Air Products Corporation) was stirred for several hours to completely wet and swell the kaolin. The mixture was then passed through a sand mill four times to reduce any clay agglomerates. To 1000 g of the mixture were added 10 ml of tetramethylorthosilicate, and the resulting mixture was coated at 50 ml/m$^2$ onto grained anodized aluminum using conventional means and allowed to dry. The dry coating was then baked at 100° C. for 30 minutes to cure the hardener. The clay ink receiving layer was then overcoated with a 1 micron thick layer of 2% hydroxyethylcellulose in water and allowed to dry. The dry hydroxyethylcellulose was overcoated with a 4 micron thick layer of 4% gelatin and allowed to dry.

The resulting ink jet receiving element was loaded into an Epson Stylus Color 600 printer and printed with an image created in an Adobe Photoshop program and adjusted to have a much higher than normal color density. After printing the image was allowed to equilibrate for 3 minutes and then the removable ink delivery layer was peeled from the ink receiving layer, revealing the correct density image with improved hue and uniformity in the low density areas.

The invention has been described in detail with particular reference to certain preferred embodiments thereof, but it will be understood that variations and modifications can be effected within the spirit and scope of the invention.

PARTS LIST substrate
ink receiving layer
removable ink delivery layer
ink jet droplets
small ink droplet
equilibrium distribution of ink

What is claimed is:

1. An ink jet receiver which provides variable dot sizes, comprising:

a) a substrate;

b) an ink-receiving layer disposed over the substrate; and c) a removable ink delivery layer disposed on the ink-receiving layer which, in response to a droplet of ink, absorbs a portion of the ilk and delivers another portion of the ink to the ink-receiving layer so that a dot is formed in the ink-receiving layer.

2. An ink jet receiver which provides variable dot sizes, comprising:

a) a substrate;

b) an ink-receiving layer disposed over the substrate; and c) a removable ink delivery layer disposed on the ink-receiving layer which, in response to a droplet of ink, absorbs a portion of the ink and delivers a smaller droplet to the ink-receiving layer so that a smaller dot size is formed on the ink-receiving layer than delivered to the removable ink delivery layer.

3. The ink jet receiver of claim 2 wherein the removable ink delivery layer includes a limited adhesion material chosen from the group of water soluble polymers including hydroxyethyl cellulose, hydroxypropyl cellulose, carbomethoxycellulose, cellulose gum, polyvinylalcohol, polyvinyl pyrroldinone, polyacrylamide, acacia gum, agar, algin, carrageenan, fucoidan, laminaran, corn hull gum, gelatin, gum ghatti, gum arabic, guar gum, karaya gum, locust bean gum, pectin, dextrans, or starches.

4. The ink jet receiver of claim 2 wherein the ink receiving layer includes clay, colloidal silica, a water soluble polymeric binder, and a hardener.

5. The ink jet receiver of claim 4 wherein the clay is kaolin, the hardener is a tetraalkoxysilane and the water soluble binder is chosen from the group of water soluble polymers including hydroxyethyl cellulose, hydroxypropyl cellulose, carbomethoxycellulose, cellulose gum, polyvinylalcohol, polyvinyl pyrroldinone, polyacrylamide, acacia gum, agar, algin, carrageenan, fucoidan, laminaran, corn hull gum, gelatin, gum ghatti, gum arabic, guar gum, karaya gum, locust bean gum, pectin, dextrans, and starches.

6. An ink jet receiver which provides variable dot sizes, comprising:

a) a substrate;

b) an ink-receiving layer disposed over the substrate; and c) a removable ink delivery layer disposed on the ink-receiving layer which, in response to a droplet of ink, absorbs a first portion of the ink and delivers a second portion of the ink to the ink-receiving layer until the first and second portions are in equilibrium.

7. The ink jet receiver of claim 5 wherein droplets of ink are delivered to the ink receiving layer in an imagewise fashion and have lower density image areas and wherein there is substantially no spacing on the surface of the ink receiving layer between the second portion of the droplets in such lower density image areas in order to minimize visible spacing between droplets.

* * * * *